US008296979B2

(12) United States Patent
Pereira et al.

(10) Patent No.: US 8,296,979 B2
(45) Date of Patent: Oct. 30, 2012

(54) BANNER APPARATUS AND METHOD OF USE

(75) Inventors: Steve Pereira, Dana Point, CA (US); Kris Stewart, Harbor City, CA (US); Carl Tenbrink, Huntington Beach, CA (US); Scott Willis, Corona, CA (US)

(73) Assignee: Steve Pereira, Dana Point, CA (US)

( * ) Notice: Subject to any disclaimer, the term of this patent is extended or adjusted under 35 U.S.C. 154(b) by 167 days.

(21) Appl. No.: 12/450,589

(22) PCT Filed: Aug. 21, 2008

(86) PCT No.: PCT/US2008/009940

§ 371 (c)(1),
(2), (4) Date: Apr. 8, 2010

(87) PCT Pub. No.: WO2009/025833

PCT Pub. Date: Feb. 26, 2009

(65) Prior Publication Data

US 2010/0192432 A1 Aug. 5, 2010

Related U.S. Application Data

(60) Provisional application No. 60/966,175, filed on Aug. 23, 2007.

(51) Int. Cl.
*G09F 21/04* (2006.01)

(52) U.S. Cl. ..... 40/591; 40/212; 40/218; 40/412

(58) Field of Classification Search ..... 40/591, 40/212, 215, 218, 592, 412, 413; 116/28 R, 116/173

See application file for complete search history.

(56) References Cited

U.S. PATENT DOCUMENTS

| | | | | | |
|---|---|---|---|---|---|
| 2,090,121 | A | * | 8/1937 | Hayes | 116/173 |
| 2,216,776 | A | * | 10/1940 | Hoffman | 273/360 |
| 2,238,876 | A | * | 4/1941 | Manson | 273/360 |
| 2,478,273 | A | * | 8/1949 | Jenkins | 343/899 |
| 4,989,356 | A | | 2/1991 | Combs | |
| 5,320,061 | A | | 6/1994 | Laughlin | |
| 5,573,281 | A | | 11/1996 | Keller | |
| 5,810,637 | A | | 9/1998 | Mileti | |
| 6,032,523 | A | * | 3/2000 | Smith | 73/170.07 |
| 6,672,243 | B2 | | 1/2004 | Seymour et al. | |
| D581,824 | S | * | 12/2008 | Catner | D10/109.1 |
| 2002/0021948 | A1 | | 2/2002 | Stumpf et al. | |
| 2005/0217557 | A1 | | 10/2005 | Caetana et al. | |
| 2006/0156600 | A1 | | 7/2006 | Barker | |

* cited by examiner

*Primary Examiner* — Lesley D Morris
*Assistant Examiner* — Christopher E Veraa
(74) *Attorney, Agent, or Firm* — Mind Law Firm, P.C.; Jeromye V. Sartain; Justin G. Sanders

(57) ABSTRACT

A banner apparatus comprising a base having a substantially symmetrical central core formed in an upper end of the base and a banner-insert sub-assembly removably installed within the core from either open end. The core has a substantially symmetrical and central stepped inner surface that is accessible from each open end. The banner-insert sub-assembly comprises an insert having at least one passage therethrough and a windsock banner installed over the insert so as to be pinched between the insert and the core when the banner-insert sub-assembly is removably installed within the core during use, the banner having a proximal end and a distal end and at least one airflow channel in communication therebetween and with the passage and the core so as to allow airflow through the base and the banner to aid its substantially horizontal flight during use.

13 Claims, 6 Drawing Sheets

BANNER APPARATUS AND METHOD OF USE

RELATED APPLICATIONS

This application claims priority to and is entitled to the filing date of U.S. Provisional application Ser. No. 60/966,175 filed Aug. 23, 2007, and entitled "Banner Apparatus and Method of Use." The contents of the aforementioned application are incorporated herein by reference.

INCORPORATION BY REFERENCE

Applicant hereby incorporates herein by reference any and all U.S. patents and U.S. patent applications cited or referred to in this application.

TECHNICAL FIELD

Aspects of this invention relate generally to banners, and more particularly to an apparatus and method for flying banners.

BACKGROUND ART

In the art, a variety of devices are known for displaying flags and the like from vehicles such as cars, boats and airplanes. Such devices may involve a wide range of approaches, from relatively simplistic flags and flag poles to power operated, remotely controlled flags or banners that can be let out or in while the vehicle is in motion. By way of example, specific prior art references of which the inventors are aware include U.K. 263,986 to Barrett issued on Jan. 13, 1927, U.S. Pat. No. 1,973,389 to Pieper issued on Sep. 11, 1934, U.S. Pat. No. 2,090,121 to Hayes issued on Aug. 17, 1937, U.S. Pat. No. 2,478,273 to Jenkins issued on Aug. 9, 1949, U.S. Pat. No. 2,651,127 to Rubin et al. issued on Sep. 8, 1953, U.S. Pat. No. 2,949,094 to Clothier issued on Aug. 16, 1960, U.S. Pat. No. 3,148,856 to Orlando issued on Sep. 15, 1964, U.S. Pat. No. 4,178,706 to Boyce issued on Dec. 18, 1979, U.S. Pat. No. 4,209,151 to Saunders issued on Jun. 24, 1980, U.S. Pat. No. 4,499,678 to Moreau issued on Feb. 19, 1985, U.S. Pat. No. 4,601,255 to Marcotti issued on Jul. 22, 1986, U.S. Pat. No. 4,901,662 to Sandeen et al. issued on Feb. 20, 1990, U.S. Pat. No. 4,989,356 to Combs issued on Feb. 5, 1991, U.S. Pat. No. 5,044,301 to Peters et al. issued on Sep. 3, 1991, U.S. Pat. No. D339,168 to Gerhart et al. issued on Sep. 7, 1993, U.S. Pat. No. 5,320,061 to Laughlin et al. issued on Jun. 14, 1994, U.S. Pat. No. D383,137 to Gamble, Jr. et al. issued on Sep. 2, 1997, U.S. Pat. No. 5,692,331 to Tipke issued on Dec. 2, 1997, U.S. Pat. No. 5,974,711 to Tipke issued on Nov. 2, 1999, U.S. Pat. No. 6,247,423 to Ingram et al. issued on Jun. 19, 2001, and U.S. Pat. No. 6,672,243 to Seymour et al. issued on Jan. 6, 2004.

The prior art summarized above teaches a number of flag, banner and wind sock display devices, and the like, but does not teach an improved display device wherein various wind socks are more readily and effectively replaced within and flown from a vehicle-mounted support mechanism. Aspects of the present invention fulfill these needs and provide further related advantages as described in the following disclosure.

DISCLOSURE OF INVENTION

Aspects of the present invention teach certain benefits in construction and use which give rise to the exemplary advantages described below.

The present invention is generally directed to a banner apparatus and method involving a base and a banner-insert sub-assembly removably installed in the base.

An aspect of the present invention may then be generally described as a base having a substantially symmetrical central core formed in an upper end of the base and a banner-insert sub-assembly removably installed within the core from either open end.

A further aspect of the present invention may be generally described as the core having a substantially symmetrical and central stepped inner surface.

A still further aspect of the present invention may be generally described as the banner-insert sub-assembly comprising an insert having at least one passage therethrough and a windsock banner installed over the insert so as to be pinched between the insert and the core when the banner-insert sub-assembly is removably installed within the core during use.

A still further aspect of the present invention may be generally described as the banner having a proximal end and a distal end and at least one airflow channel in communication therebetween and with the insert passage and the base core so as to allow airflow through the base and the banner to aid its substantially horizontal flight during use.

A still further aspect of the present invention may be generally described as the base further comprising two substantially symmetrical, substantially vertical faces formed on opposite sides of the central core.

A still further aspect of the present invention may be generally described as the insert further comprising a plurality of outwardly-projecting ribs configured to engage the stepped inner surface of the core when the banner-insert sub-assembly is installed therein.

A still further aspect of the present invention may be generally described as the insert being formed with a circumferential flange proximal of the ribs and the banner being formed with a relatively thicker proximal lip configured to engage the flange upon installation of the banner on the insert to form the banner-insert sub-assembly.

A still further aspect of the present invention may be generally described as the insert having two passages separated by a structural wall, whereby the structural wall stabilizes the insert and provides a means for grasping the insert when inserting or removing the banner-insert sub-assembly into or from the base.

A still further aspect of the present invention may be generally described as the banner having a front wall and a substantially opposite back wall defining a body and being further formed with two lengthwise substantially horizontal stitches joining the front and back walls from a proximal location offset distally from the proximal end so as to allow for the insertion of the insert at the proximal end of the banner and extending lengthwise along the body of the banner substantially to the distal end thereof, whereby the banner is substantially vertically divided into three substantially parallel airflow channels, each channel communicating with the proximal and distal ends of the banner.

A still further aspect of the present invention may be generally described as the banner and the insert being removably assembled.

A still further aspect of the present invention may be generally described as the banner being permanently installed on the insert.

Other features and advantages of aspects of the present invention will become apparent from the following more detailed description, taken in conjunction with the accompanying drawings, which illustrate, by way of example, the principles of aspects of the invention.

BRIEF DESCRIPTION OF DRAWINGS

The accompanying drawings illustrate aspects of the present invention. In such drawings.

MODES FOR CARRYING OUT THE INVENTION

The above described drawing figures illustrate aspects of the invention in at least one of its exemplary embodiments, which are further defined in detail in the following modes.

The subject of this patent application is an improved banner apparatus generally comprising a support mechanism and a wind sock banner removably affixed thereto. As will be appreciated by those skilled in the art, and in view of following detailed description of various embodiments, while at least one particular construction of the banner apparatus is shown and described, the invention is not so limited. Rather, numerous other configurations or combinations of the components, both now known or later developed, may be employed in the present invention without departing from its spirit and scope.

Figure 1:
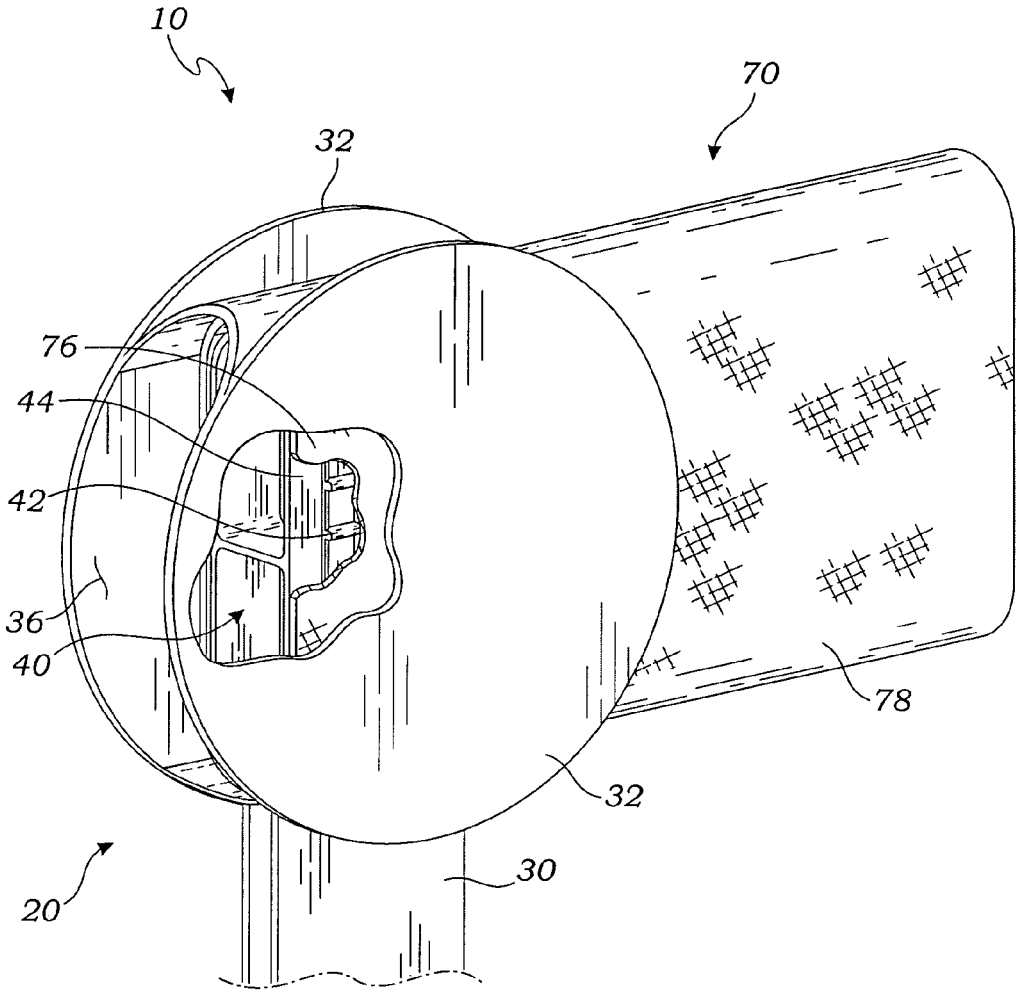
FIG. 1 is a partial perspective view of an exemplary embodiment of the banner apparatus of the present invention, partially cut away.

Referring first to FIG. 1, in an exemplary embodiment, the banner apparatus 10 comprises a base 20, an insert 40, and a wind sock banner 70, with the wind sock 70 having one or more lengthwise airflow channels 80 (FIGS. 5 and 7) and the base 20 and insert 40 cooperating to enable removable installation of the banner 70 from either side of a symmetrical central core 26 (FIG. 2) of the base 20 flanked by opposite symmetrical faces 32, whereby the entire apparatus 10 can be conveniently installed on either side of a vehicle. Other embodiments are disclosed in which a retractable banner or wind sock 70 can instead be removably installed within the core 26 of the mounting base 20 or in which the wind sock banner 70 is sewn onto the insert 40 and the integral sub-assembly 90 is then removably installed in the base 20. Various details relating to alternative construction of the components are also shown and described. As such, it will be appreciated by those skilled in the art that the present invention is not limited to any particular embodiment, which are each merely illustrative of the principles of the invention, but is generally directed to aspects of such an apparatus and method that may be achieved by structure both now known and later developed. Accordingly, the subject of this patent application is generally to be understood as a banner apparatus and method of its use whereby interchangeable wind sock banners may be removably mounted on a vehicle or other object for the purpose of selectively displaying a message or other such information or decorative design.

Figure 2:
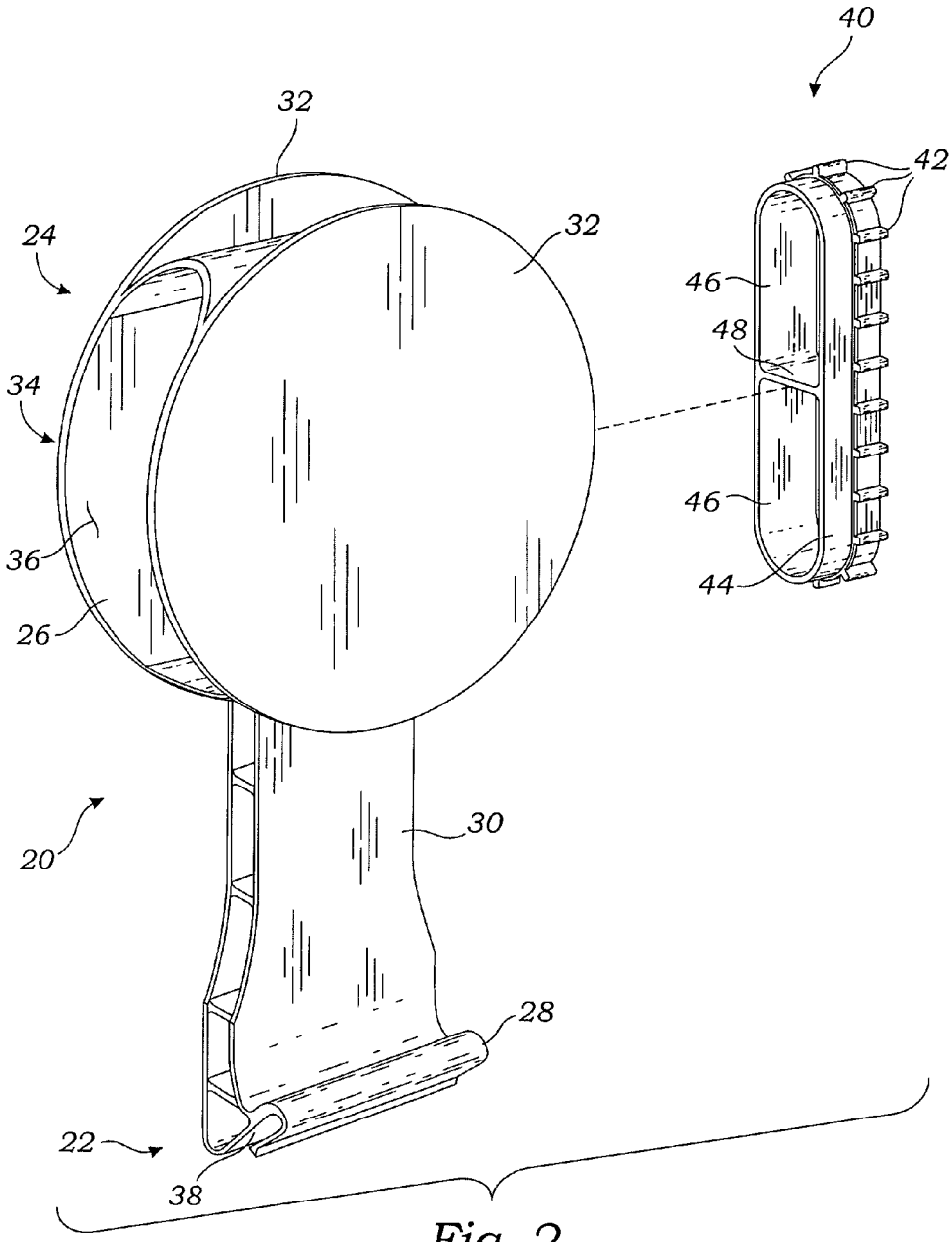
FIG. 2 is a partial, exploded perspective view thereof.

Once more, as shown in FIG. 1 and with further reference to FIG. 2, the banner apparatus 10 of the present invention is generally directed to a base component 20 configured at a lower end 22 to be removably installed on the upper edge of a vehicle door or window and configured at its opposite upper end 24 with a horizontal core 26 open at both ends 34 and within which the insert-banner assembly 90 may be press-fit from either end, the details of which are explained further below. It will be appreciated that the precise construction of the base 20, including the size and orientation of the clip 28 formed at the lower end 22, the length and angle of the vertical support arm 30, the cross-section of the core 26, and the size and shape of the opposite faces 32 flanking the core 26, can vary and that the exemplary embodiment shown and described is merely for illustration. Moreover, other mechanical means of removably installing the banner 70 on the base 20 from either direction and of mounting the entire assembly 10 on a vehicle 100 (FIG. 8), whether now known or later developed, could be employed without departing from the spirit and scope of the invention.

Figure 3:
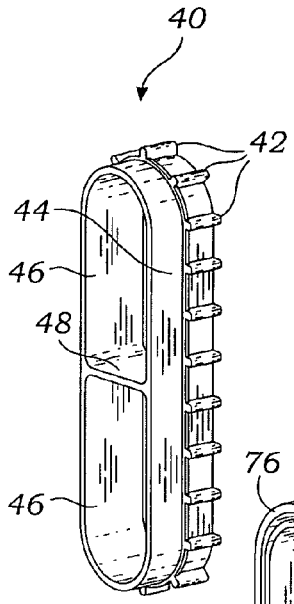
FIG. 3 is a perspective view of a component thereof.

Turning now to FIG. 2, there is shown an exploded view of the assembly of the base 20 and insert 40. Again, the base 20 is formed at its upper end 24 with a horizontal core 26 into which the insert 40 is removably inserted. In the exemplary embodiment, both the core 26 and the insert 40 are formed having a roughly rectangular cross-section with rounded short sides. No matter the shape, in one aspect of the present invention, the cross-sections of the core 26 and the insert 40 substantially correspond so as to achieve a press- or interference-fit between the outer surfaces or contact points of the insert 40 and the inner surface 36 of the core 26. More specifically, in the exemplary embodiment, the inner surface 36 of the core 26 is stepped inwardly and symmetrically from its respective opposite ends 34 so that the insert 40 as covered by the banner 70 seats in the core 26 as the insert 40 is inserted from either end 34. It will be appreciated by those skilled in the art that while a stepped inner surface 36 is disclosed in the exemplary embodiment as the means of producing the interference fit and thus removably installing the banner-insert sub-assembly 90 within the core 26, the invention is not so limited. Rather, a variety of other mechanical means now known or later developed may be employed in removably securing the banner 70 in the base 20. For example, alone or in combination with the stepped inner surface 36, the central core 26 may alternatively be formed with a slight inward taper from each opening 34 toward the core's center, which taper furthers the interference fit between the banner-insert sub-assembly 90 and the core 26 as the sub-assembly 90 is inserted further in from either open end 34. As best shown in FIG. 3, to further aid in the removable securement of the insert 40 within the core 26 of the base 20, the insert 40 may be formed with a series of bosses or ribs 42 about its perimeter that engage in effective point or line contact with the inner surface 36 of the core 26, thereby staking the insert 40 within the core 20 without excessive surface contact that, with the banner 70 passing over the insert 40 between the insert 40 and the core 26, could render insertion and removal of the banner-insert sub-assembly 90 more difficult in practice. The insert 40, as best shown in FIGS. 2 and 3, is further formed with at least one passage 46 therethrough to allow communication of air entering the core 26 with the interior space or the one or more airflow channels 80 of the banner 70. In the exemplary embodiment, the insert 40 is formed with two passages 46 separated by a structural wall 48, which serves to both strengthen the insert 40 and maintain its shape during use, but also as a handle for gripping and removal of the insert 40, or essentially the banner-insert sub-assembly 90, from the base 20. In the exemplary embodiment, the base 20 and the insert 40 are both formed as through an injection molding process of polypropylene copolymer and the banner 70 is formed as through a textile and sewing process of rip-stop nylon with nylon thread used to form the horizontal stitches that create multiple airflow channels 80 and distal end 74 while both nylon and polyester thread is used at the proximal end 72 to encapsulate the insert 40. However, those skilled in the art will appreciate that a variety of other materials and fabrication methods now known or later developed may be employed without departing from the spirit and scope of the present invention, such that the invention is expressly not limited to any such exemplary materials.

Figure 4:
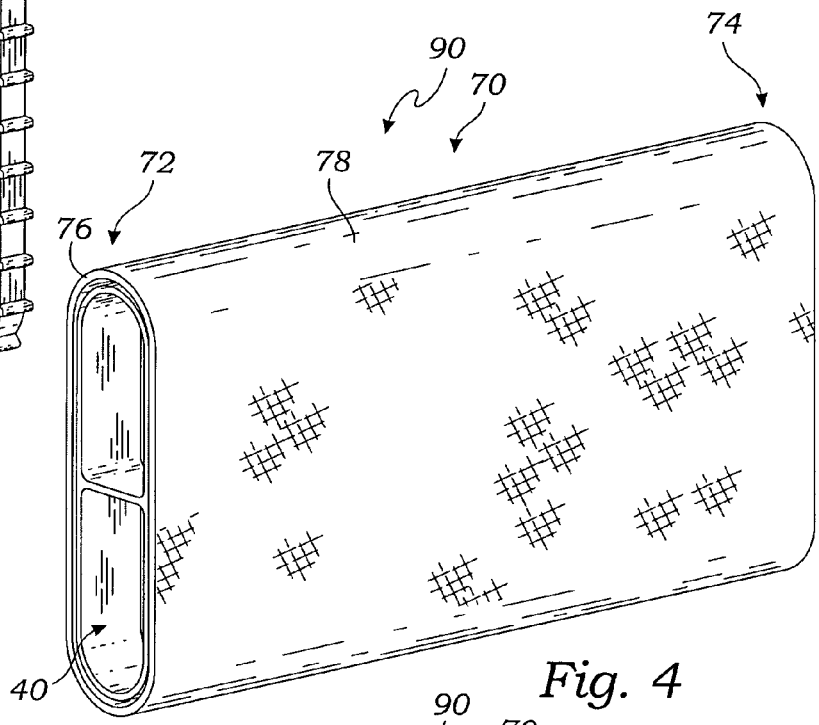
FIG. 4 is a perspective view of a sub-assembly thereof.
Figure 5:
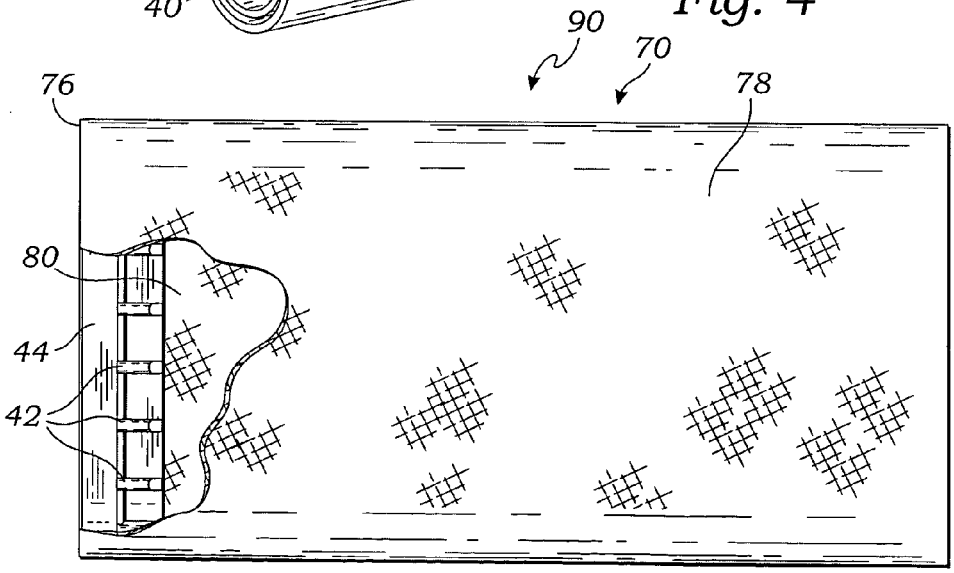
FIG. 5 is a side view of the sub-assembly of FIG. 4, partially cut away.

Referring now to FIGS. 4 and 5, the removable installation of the wind sock banner 70 over the insert 40 so as to form a banner-insert sub-assembly 90 for subsequent insertion within the base core 26 is shown. The lip 76 formed at the proximal end 72 of the banner 70 may be formed thicker than the body 78 of the banner 70 extending to its opposite distal end 74 that would fly during operation, as explained further below. A corresponding flange 44 is also formed on the insert 40 proximal of the ribs 42, whereby during installation the thicker lip 42 of the banner 70 seats substantially adjacent, on, or about the insert flange 44. Then, when the banner-insert sub-assembly 90 is inserted within the core 26 of the base 20, the banner lip 76 is seated on and pinched substantially between the insert flange 44 and the inside surface 36 of the base core 26, effectively locking the banner-insert assembly 90 in place, as by a press- or interference-fit, whereby no fasteners or tools are required, which assembly is also clearly shown in the partial cut-away view of FIG. 1. The lip 76 of the banner 70 may have an elastic material to further aid in assembly, or in getting the banner 70 on and off of the insert 40 while at the same time further securing the banner 70 on the insert 40 proximal of the circumferential ribs 42, thereby preventing wind force on the banner 70 during use from inadvertently pulling the banner 70 out of the base 20. Rather, the greater the wind force, the more securely the banner-insert sub-assembly 90 seats within the core 26 of the base 20. As also best shown particularly in the partial cut-away portion of the view of FIG. 5, in the exemplary embodiment, a single airflow channel 80 is formed within the banner 70 as essentially defined by the inner surface of the body 78 of the banner 70 extending distally of the lip 76 and hence the insert 40 when inserted or installed within the banner 70 to form the banner-insert sub-assembly 90. It will be appreciated that as the vehicle 100 (FIG. 8) on which the banner apparatus 10 is installed is in motion, it is this interior space or airflow channel 80 through which air may flow, in cooperation with the core 26 formed in the base 20 and the one or more passages 46 formed in the insert 40, that functions to fly or unfurl the banner 70 so that any message imprinted or otherwise affixed to the body 78 of the banner 70 is then made visible.

Figure 6:
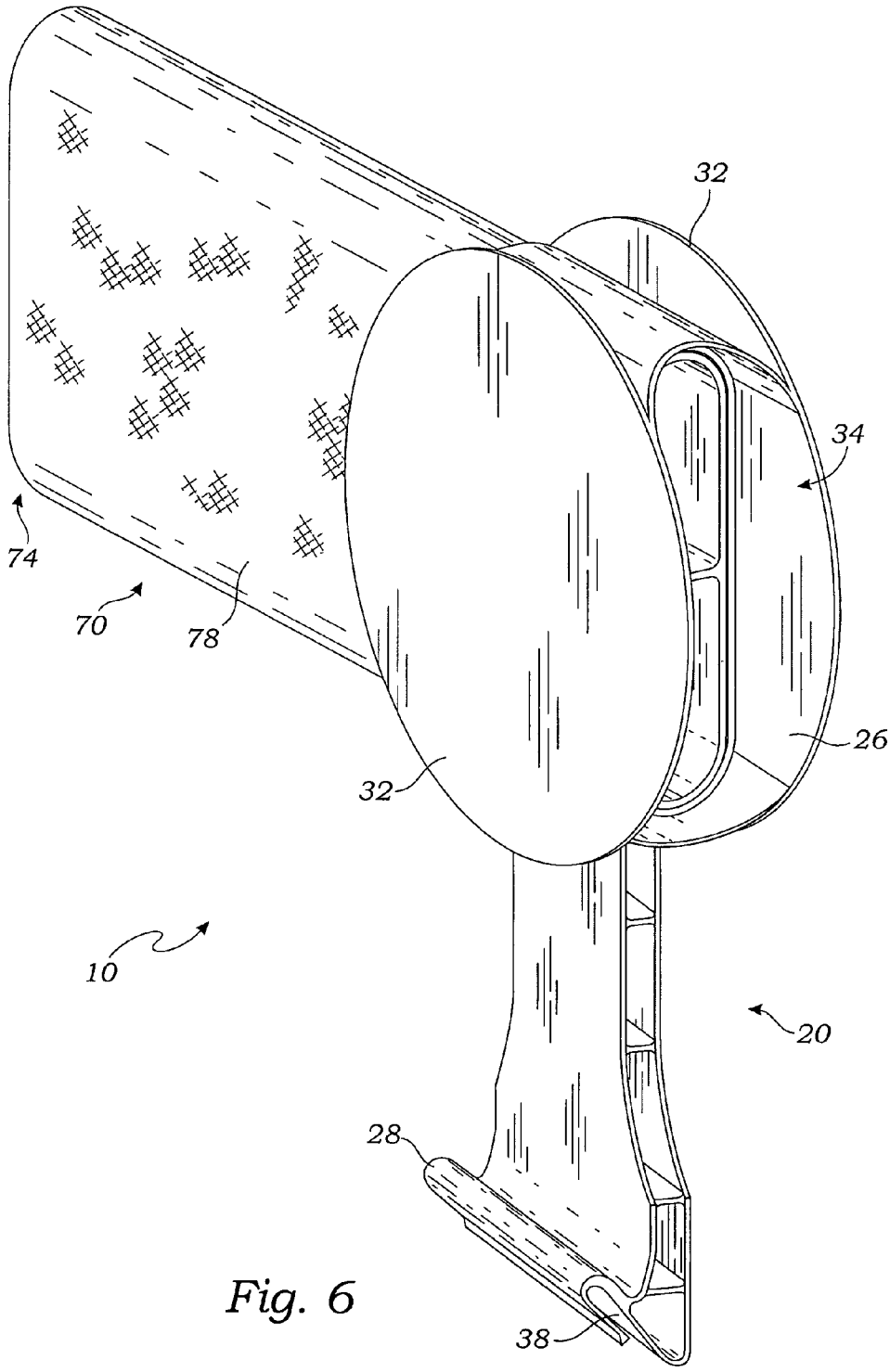
FIG. 6 is a complete perspective view of the exemplary embodiment of the banner apparatus of the present invention shown in FIGS. 1-5.

Turning then to FIG. 6, there is shown an isometric view of the complete banner apparatus 10 as would be removably installed on a vehicle door or window. In use, the insert 40 and banner 70, or the banner-insert sub-assembly 90, slide in from what will be the front of the apparatus 10, or into the end 34 of the core 26 that opens in or toward the direction the vehicle 100 (FIG. 8) and hence the banner apparatus 10 will be traveling, again depending on the side of the vehicle 100 the apparatus 10 is intended to be installed on. As shown in FIG. 1, the banner-insert sub-assembly 90 is press-fit or secured in place through the insert flange 44 and insert ribs 42 engaging the banner lip 76 and banner body 78, respectively, or effectively pinching the lip 76 and body 78 between the insert 40 and the core 26 as explained above. It will be appreciated by those skilled in the art that with such an installation, the banner-insert sub-assembly 90 is effectively front-loaded, whereby the force of airflow over and through the banner 70 serves to further keep the banner-insert sub-assembly 90 secured within the base 20 during use. And, again, the symmetrical design of the base 20, including the core 26 being formed with basically identical opposite open ends 34 and having on opposite sides substantially similar vertical faces 32, allows the banner-insert sub-assembly 90 to be inserted from either end of the core 26, thereby enabling the entire banner apparatus 10 to be installed on either side of the vehicle 100 (FIG. 8) based on the user's preference. The opposite faces 32 of the base 20 may hold or bear a decal with a message or graphic. It will be appreciated that the sizes and shapes of such faces 32 are virtually limitless, such that the opposite round faces 32 shown are to be understood as merely exemplary. In some cases the faces 32 may not be identical or only one face 32 will be employed for a variety of reasons. Though not shown, custom covers may snap together over the outside of the base 20 to provide further aesthetic and functional benefits, such as more surface area for shapes and graphics, greater rigidity or strength of the resulting assembly, or improved drag characteristics of the apparatus 10. Regarding the clip 28 formed at the lower end 22 of the base 20 for window or door installations, on the flat support surface 38 of the clip 28 adjacent to the outer surface of the window 102 (FIG. 8), a foam/rubber pad, piece of adhesive or suction cup may be used to secure the base 20 laterally to the window 102. Those skilled in the art will appreciate that other such temporary mounting means now known or later developed, whether alone or in various combinations, may be employed without departing from the spirit or scope of the invention. Furthermore, once again, for installations of the banner apparatus 10 not involving the window or door, such as on the hood or roof of a vehicle, other hardware such as mounting brackets, suction cups, etc., again whether now known or later developed, can be utilized in conjunction with the present invention.

Figure 7:
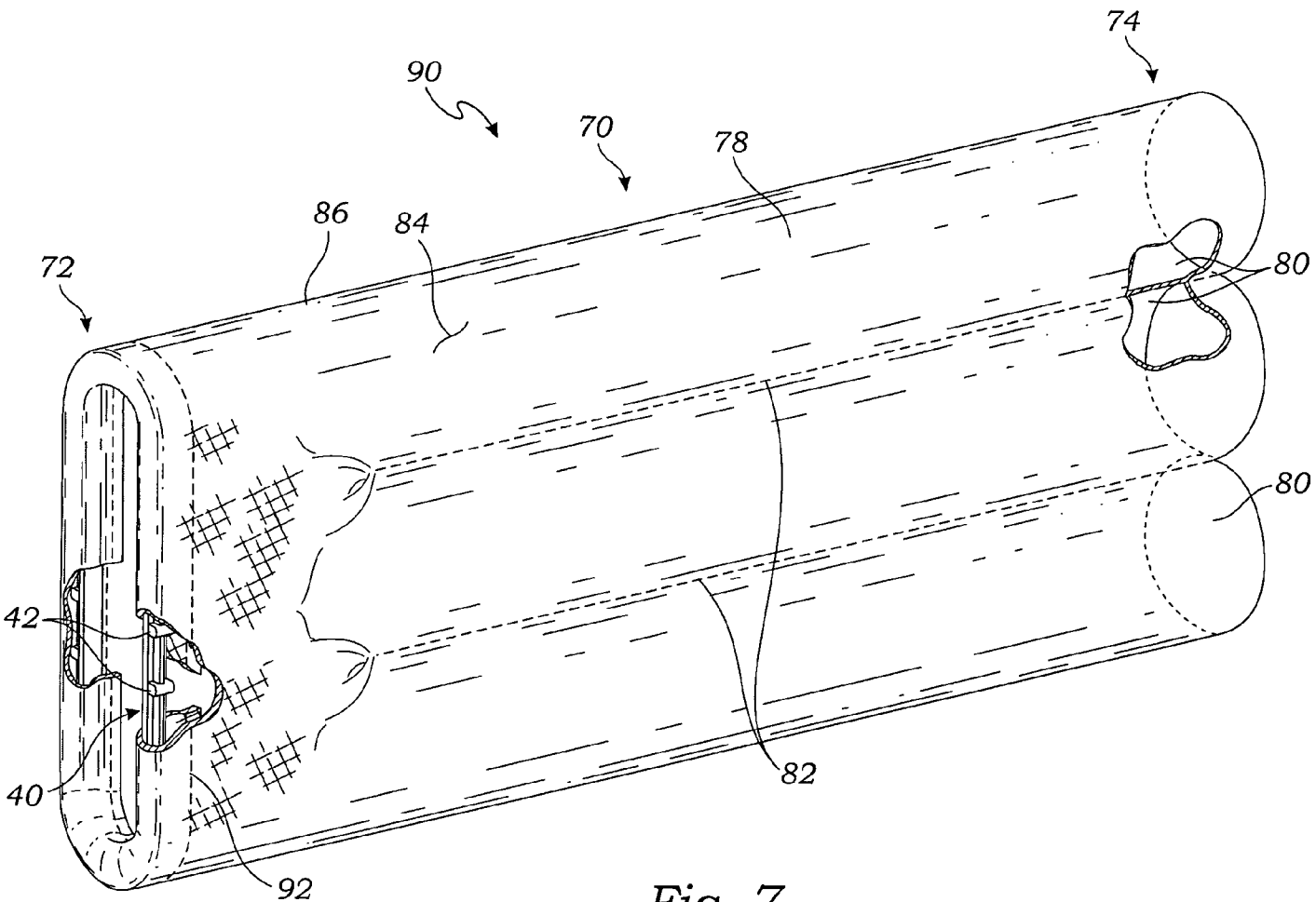
FIG. 7 is a perspective view of an alternative sub-assembly thereof, partially cut away.

Further, turning now to FIG. 7, regarding the wind sock banner 70 itself, in an alternative exemplary embodiment the banner 70 is configured with two lengthwise, horizontal stitches 82 joining the front and back walls 84, 86 from a proximal location offset distally from the proximal end 72 so as to allow for the insertion of the insert 40 and extending lengthwise along the body 78 of the banner 70 substantially to the distal end 74 thereof, thus vertically dividing the interior space of the wind sock 70 into three substantially parallel airflow channels 80, each channel 80 communicating with the opposite open ends of the wind sock 70 as described above. Such a banner construction would still substantially correspond to the profile of the insert 40 and cooperate with the core 26 of the base 20 and the passages 46 through the insert 40 to allow airflow therethrough, as best seen in FIG. 1 above, while now providing for multiple airflow channels 80 lengthwise along the interior space of the wind sock banner 70. It will be appreciated by those skilled in the art that the provision within the banner 70 of two or more channels effectively forces the air through the banner 70 in a substantially horizontal and parallel direction, resulting in relatively more laminar air flow and greater stability of the banner 70 as it flies, and thus less whipping and wear and tear on the banner 70 and better legibility of any message or graphics 84 printed on the banner 70. Accordingly, it will be further appreciated that while three lengthwise airflow channels 80 are formed within the wind sock banner 70 of the alternative exemplary embodiment shown in FIG. 7, any number and orientation of the channels 80 is possible without departing from the spirit and scope of the present invention. Relatedly, it will be appreciated that while the multiple airflow channels 80 are shown as being formed by stitching opposite sides 84, 86 of the banner body 78 lengthwise to form stitches 82 and stake or gather the banner material and form the resulting horizontal channels 80, other means of forming such channels 80 now known or later developed may also be employed without departing from the spirit and scope of the invention, such as ultrasonic welding, heat welding, or solvent bonding. Moreover, while the wind sock 70 is shown as having a substantially rectangular profile and a somewhat rectangular or oval cross-section, it will be appreciated that a virtually infinite variety of wind sock shapes, in profile or cross-section, are possible within the present invention, such that the invention is not limited to the exemplary geometry of the base 20, insert 40 and banner 70. With continued reference to FIG. 7, the alternative embodiment of the banner-insert sub-assembly 90 also entails the permanent installation of the banner 70 on the insert 40 such that this sub-assembly 90, and hence any replacement sub-assemblies a user may procure, come as a pre-installed unit that is then simply removably inserted within the base 20 as described above. Those skilled in the art will appreciate that in this alternative embodiment the effective number of parts in the finished banner apparatus 10 is reduced from three to two, making installation and use even easier. It will be further appreciated that any means now known or later developed for attaching the banner 70 to the insert 40 may be employed in the present invention without departing from its spirit and scope, such as sewing, welding, bonding, or fastening. In the exemplary embodiment, the banner body 78 at the proximal end 72 is simply wrapped or folded over the outside of the insert 40 and then back through the inside of the insert 40 and sewn to itself, or to the front and back walls 84, 86 of the banner 70, specifically, at stitch 92, whereby the insert 40 is enclosed by or sewn within the banner 70 to form an integral banner-insert sub-assembly 90. While this could be accomplished while still retaining the intermediate structural wall 48 (FIGS. 2 and 3) of the insert 40 by, for example, notching the proximal end 72 of the banner body 78 at the appropriate locations, as shown in the alternative exemplary embodiment of FIG. 7, the intermediate structural wall 48 has been removed for simplicity of design. Furthermore, with continued reference to FIG. 7, the insert 40 is shown as also having the proximal flange 44 removed and instead the perimeter ribs 42 now extending proximally to cover substantially the full depth of the insert 40. In this manner, the ribs 42 span the outer perimeter of the insert 40 for engagement with the inner surface 36 of the core 26, with again the banner 70 actually being wedged or pinched between the insert 40 and the core 26 during normal use of the apparatus 10. It will again be appreciated that a number of other configurations of the banner and insert and the means by which they are formed together as a single unit or sub-assembly now know or later developed are possible in the present invention without departing from its spirit and scope.

By way of further illustrative structure, while in the exemplary embodiment the wind sock banner 70 is not formed with any kind of automatic or biasing retraction means, but instead would just fly substantially horizontally as the vehicle 100 (FIG. 8) on which it is installed is in motion and then just droop down when the vehicle 100 slows or stops, much like a standard flag, it is further contemplated that a variety of spring or other such biasing means could be incorporated in the banner 70 and/or insert 40 to cooperate in retracting, winding, or otherwise pulling the wind sock banner 70 toward the base 20 when it is not being flown as by the wind force caused by the vehicle 100 being in motion. For example, the wind sock 70 could be formed having a coil spring or the like sewn within one or more of the seams 82 along which the opposite sides 84, 86 of the body 78 of the wind sock banner 70 are tacked in forming the multiple airflow channels 80, whereby the spring could be overcome by the air force of a moving vehicle, but then recoil and thus retract the wind sock banner 70 when the vehicle slows or stops. In an alternative embodiment, a more conventional non-hollow banner could be flown from the same base as by being installed on a pole removably spanning the core, such flag banner having a coil spring or the like incorporated therein much like the alternative wind sock banner 70 described immediately above. Or, the flag-type banner could be incorporated within a spring-biased cartridge or the like that is removably installed within the base core much like the insert in the wind sock embodiment. With any such flat banner devices, the banner 70 could have at its distal end 74 opposite the base 20 a wind foil, parachute or other such structure designed to catch more of the wind passing over and through the base 20 as the vehicle 100 is in motion and so fully extend the banner 70. Those skilled in the art will appreciate that a variety of such configurations of the banner 70 and mechanical means for selectively retracting the banner 70 are possible without departing from the spirit and scope of the invention.

Figure 8:
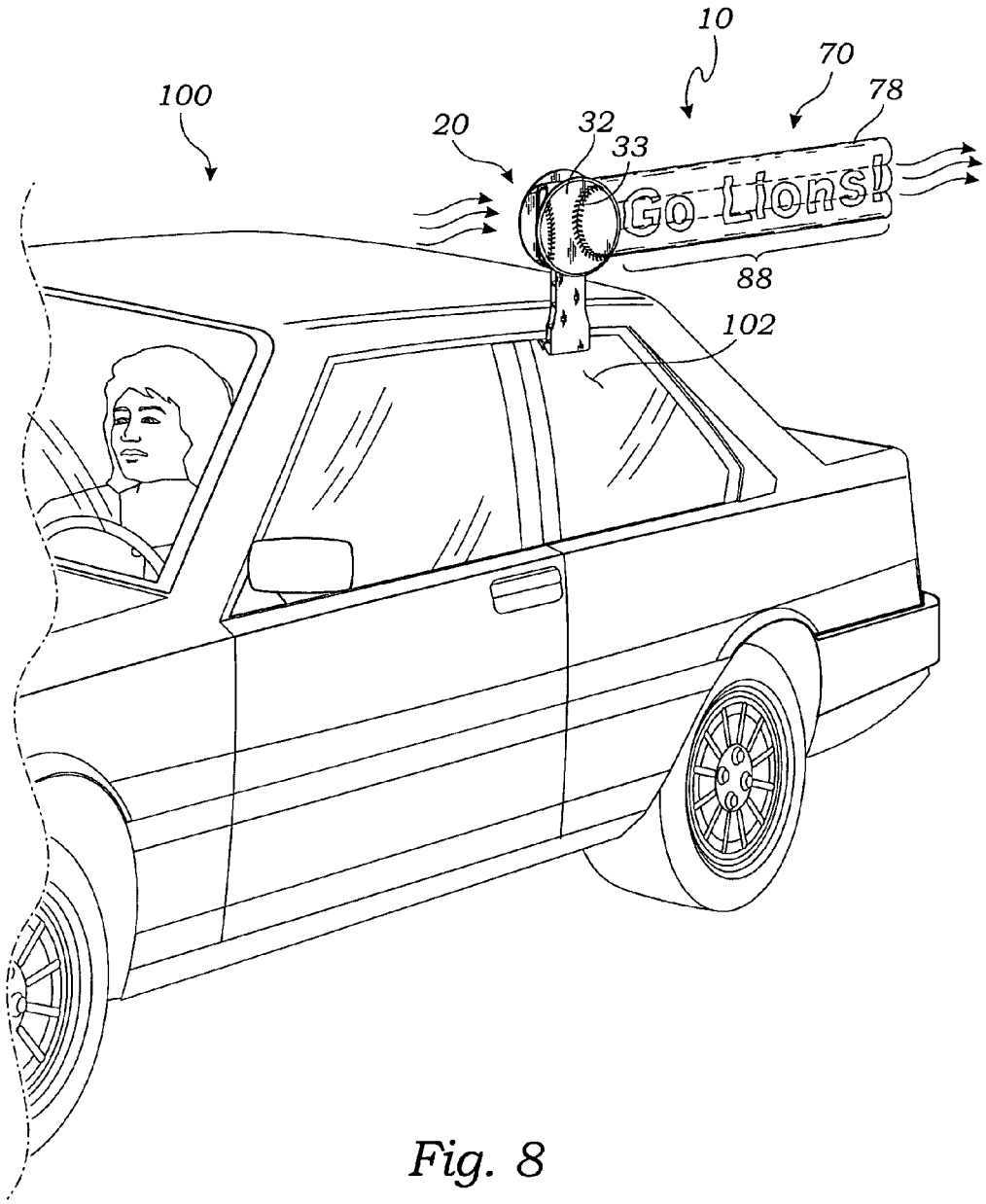
FIG. 8 is a reduced scale complete perspective view of an alternative exemplary embodiment of the banner apparatus of the present invention incorporating the sub-assembly of FIG. 7 and shown in use.

Referring finally to FIG. 8, in use, the banner apparatus 10 of the present invention may be selectively installed on a door or window 102 of a vehicle 100 and operate in any manner as described above depending on the specific embodiment. In the alternative embodiment incorporating a banner 70 as shown in FIG. 7, when such a banner is installed in the base 20 and the vehicle 100 on which the base 20 is mounted is driven, the banner 70 extends substantially horizontally and rearwardly from the base 20. The banner may include graphics 88 on one or both sides 84, 86 (FIG. 7) that are then visible as the banner 70 flies. The banner 70 may further include graphics illustrating or providing instructions on its use that may also be printed directly on the banner 70, preferably in a location not visible when the banner is installed and is flying. Similarly, the opposite faces 32 of the base 20 may include graphics 33, which may be applied by any technique of application now known or later developed. It will be appreciated by those skilled in the art that banners 70 according to aspects of the present invention bearing different graphics 88 can quickly and easily be replaced within the core 26 of the base 20 depending on the needs or desires of the user. For example, a user can display an advertising message on the banner 70 for her or someone else's business and then when she is going to a sporting event for her favorite team can replace the "advertising banner" with a "team banner." The graphics 33 on the opposite faces 32 of the base 20 may be permanent or may also be replaceable as through a static cling, permanent or semi-permanent adhesive, or other non-permanent adhesive.

To summarize, aspects of the banner apparatus and method of the present invention are directed to a device wherein banners are selectively displayed from a vehicle or the like, such banners being removably installed within a mounting base substantially symmetrically constructed so as to allow installation of the banner apparatus on either side of a vehicle and still be aesthetically pleasing regardless of the side from which the banner apparatus is viewed.

In the case where a wind sock banner is employed, the banner is formed having one or more lengthwise channels to improve the air flow through the wind sock and thus facilitate more stable, horizontal flying of the banner so as improve its visibility during use. The resulting apparatus and method provides in a functional and attractive device a relatively easy, convenient, and cost-effective means by which a user can selectively display a message of his or her choosing. Because the principles of the invention may be practiced in a number of configurations beyond those shown and described, it is to be understood that the invention is not in any way limited by the exemplary embodiments, but is instead able to take numerous forms without departing from the spirit and scope of the invention.

Therefore, while aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventors believe that the claimed subject matter is the invention.

What is claimed is:

1. A banner apparatus, the improvement comprising:

a base having a substantially symmetrical, substantially horizontal central core formed in an upper end of the base, the core having a substantially symmetrical and central inner surface and opposing open ends; and a banner-insert sub-assembly removably installed within the core from either open end, the banner-insert sub-assembly comprising:

an insert having at least one passage therethrough; and a windsock banner permanently installed over the insert so as to be pinched between the insert and the core when the banner-insert sub-assembly is removably installed within the core during use, the banner having a proximal end and a distal end and at least one airflow channel in communication therebetween and with the passage and the core so as to allow airflow through the base and the banner to aid its substantially horizontal flight during use.

2. The apparatus of claim 1, wherein the base further comprises two substantially symmetrical, substantially vertical faces formed on opposite sides of the central core.

3. The apparatus of claim 2, wherein graphics are applied to the faces.

4. The apparatus of claim 2, wherein the base is formed at a lower end opposite the upper end with a clip.

5. The apparatus of claim 4, wherein the clip has a substantially flat support surface for engagement with a vehicle window when mounting the base during use of the apparatus.

6. The apparatus of claim 1, wherein the insert has two passages separated by a structural wall, whereby the structural wall stabilizes the insert and provides a means for grasping the insert when inserting or removing the banner-insert sub-assembly into or from the base.

7. The apparatus of claim 1, wherein the banner has a front wall and a substantially opposite back wall defining a body and is further formed with two lengthwise substantially horizontal stitches joining the front and back walls from a proximal location offset distally from the proximal end so as to allow for the insertion of the insert at the proximal end of the banner and extending lengthwise along the body of the banner substantially to the distal end thereof, whereby the banner is substantially vertically divided into three substantially parallel airflow channels, each channel communicating with the proximal and distal ends of the banner.

8. The apparatus of claim 1, wherein the banner is installed on the insert through an installation means selected from the group consisting of sewing, welding, bonding, and fastening.

9. The apparatus of claim 1, wherein the insert is formed with a plurality of outwardly-projecting ribs configured to engage the inner surface of the core when the banner-insert sub-assembly is installed therein.

10. The apparatus of claim 9, wherein:

the insert is formed with a circumferential flange proximal of the ribs; and the banner is formed with a relatively thicker proximal lip configured to engage the flange upon installation of the banner on the insert to form the banner-insert sub-assembly.

11. The apparatus of claim 9, wherein:

the central inner surface of the core is stepped; and the ribs are configured to seat against the stepped inner surface of the core.

12. A banner apparatus, the improvement comprising:

a base having a substantially symmetrical, substantially horizontal central core formed in an upper end of the base and two substantially symmetrical, substantially vertical faces formed on opposite sides of the central core, the core having a substantially symmetrical and central stepped inner surface and opposite open ends; and a banner-insert sub-assembly removably installed within the core from either open end, the banner-insert sub-assembly comprising:

an insert having at least one passage therethrough and a plurality of outwardly-projecting ribs configured to engage the stepped inner surface of the core when the banner-insert sub-assembly is installed therein; and a windsock banner permanently installed on the insert to form the banner-insert sub-assembly, the banner being pinched between the insert and the core when the banner-insert sub-assembly is removably installed within the core during use, the banner having a proximal end and a distal end and a front wall and a substantially opposite back wall defining a body and is further formed with two lengthwise substantially horizontal stitches joining the front and back walls from a proximal location offset distally from the proximal end so as to allow for the insertion of the insert at the proximal end of the banner and extending lengthwise along the body of the banner substantially to the distal end thereof, whereby the banner is substantially vertically divided into three substantially parallel airflow channels, each channel communicating with the proximal and distal ends of the banner and with the passage and the core so as to allow airflow through the base and the banner to aid its substantially horizontal flight during use.

13. A method of displaying a banner, comprising the steps of:

removably and slidably inserting a banner-insert sub-assembly having a windsock banner permanently installed on an insert within a substantially symmetrical, substantially horizontal central core formed at an upper end of a base, the core having a substantially symmetrical and central inner surface and opposite open ends; and mounting the base on a vehicle through engagement of a clip formed at a lower end of the base with a window of the vehicle, whereby movement of the vehicle causes airflow through the core of the base, a passage formed in the insert of the banner-insert-sub-assembly, and at least one airflow channel formed between a proximal end and a distal end of the banner to aid its substantially horizontal flight during use.

* * * * *